United States Patent [19]

Morrell

[11] Patent Number: 4,848,820

[45] Date of Patent: Jul. 18, 1989

[54] WIRELINE RUNNING AND PULLING TOOL

[76] Inventor: Terence R. Morrell, "Winnards Perch", Sunnyside, Ridge, Wareham, Dorset BH20 5BQ, England

[21] Appl. No.: 149,318

[22] Filed: Jan. 28, 1988

[30] Foreign Application Priority Data

Jan. 29, 1987 [GB] United Kingdom ..... 8701941

[51] Int. Cl.[4] ..... E21B 31/00; E21B 31/02; E21B 31/12

[52] U.S. Cl. ..... 294/86.18; 294/86.28

[58] Field of Search ..... 294/86.18, 86.17, 86.12, 294/86.1, 86.28, 86.29, 86.33, 86.14, 86.15, 86.21, 86.25, 86.26, 86.30, 86.31, 86.32; 166/98, 99, 178

[56] References Cited

U.S. PATENT DOCUMENTS 3,950,021 4/1976 Goldschild et al. ..... 294/86.28

4,558,895 12/1985 Tamplen ..... 294/86.18

*Primary Examiner*—James B. Marbert

*Attorney, Agent, or Firm*—Sughrue, Mion, Zinn, Macpeak and Seas

[57] ABSTRACT

A wireline tool 10 is capable of permitting either a downwards hammer action for release when its top sub 12 is connected to its housing 30, or an upwards hammer action for release when its top sub is connected to its core 26, and is capable of attachment to sub-surface tools 62 of different reach dimensions by placing its shear pin 42 into a selected one of a series of longitudinally spaced apertures 40 through its core.

8 Claims, 2 Drawing Sheets

WIRELINE RUNNING AND PULLING TOOL

BACKGROUND OF THE INVENTION

The present invention relates generally to a wireline running and pulling tool for use especially by the oil, gas, water and geothermal industries.

It is of course necessary, for either operational reasons or safety reasons, to be able to release a wireline tool from a sub-surface tool attached thereto. However, the construction of the sub-surface tool may be such that the release is to be effected by an upwards hammer action or by a downwards hammer action. It is indeed first necessary for the wireline tool to have been attached to the sub-surface tool, but the location on the sub-surface tool of means for attachment to the wireline tool can vary. The axial distance along the sub-surface tool between its upper end and its said attachment means is usually referred to as its reach dimension.

Conventionally, separate and structurally distinct wireline tools have been provided for use with such different constructions and dimensions of sub-surface tools.

Commonly, the wireline tool has included a housing carrying latch means for releasable engagement with the sub-surface tool, and has further included a core capable of sliding longitudinally relatively to the housing to release the latch means from the sub-surface tool after a shear pin connecting the core to the housing has been broken by transmitting the hammer action through a tool string.

Attempts have naturally been made to reduce the range of wireline tools which may be required at different times, and the attention of the interested reader is directed to US Pat. No. 3,950,021 and EP No. 0,187,408 for further information.

It would nevertheless be of great advantage if just a single wireline tool could be provided, of a given diameter, which could be simply and easily adjusted without the need for additional parts to allow at least as good if not better universality than hitherto, by permitting either an upwards or downwards hammer action for release and/or by permitting attachment to sub-surface tools of different reach dimensions.

SUMMARY OF THE INVENTION

In accordance with one aspect of the present invention, a wireline running and pulling tool comprises a top sub for attachment to a tool string, a housing carrying latch means for releasable engagement with a sub-surface tool, and a core capable of sliding longitudinally relatively to the housing to release the latch means from the sub-surface tool after a hammer action transmitted through the tool string has broken a shear pin connecting the core to the housing, the top sub being connectible selectively either to the housing for transmission of a downwards hammer action for release or to the core for transmission of an upwards hammer action for release.

Preferably, the core is longitudinally adjustable relatively to the housing to accommodate sub-surface tools having different reach dimensions, said adjustability being achieved by providing a series of longitudinally spaced apertures in the core, with the shear pin being placed into a selected one of said longitudinally spaced apertures.

In accordance with another aspect of the present invention, a wireline running and pulling tool comprises a housing carrying latch means for releasable engagement with a sub-surface tool, and a core capable of sliding longitudinally relatively to the housing to release the latch means from the sub-surface tool after a shear pin connecting the core to the housing has been broken, the core being longitudinally adjustable relatively to the housing to accommodate sub-surface tools having different reach dimensions, and said adjustability being achieved by providing a series of longitudinally spaced apertures in the core, with the shear pin being placed into a selected one of said longitudinally spaced apertures.

Preferably, a top sub is provided for attachment to a tool string through which a hammer action is transmitted to break the shear pin, the top sub being connectable selectively either to the housing for transmission of a downwards hammer action for release or to the core for transmission of an upwards hammer action for release.

The top sub, if present, may have an external thread for threaded connection to the housing and an internal thread for threaded connection to the core.

Another preferred feature, applicable to each aspect of the present invention, is that a compression spring may be located between the housing and an abutment on the core, the abutment having an internal thread for threaded connection to the core so that the force exerted by the compression spring is easily regulated or controlled.

BRIEF DESCRIPTION OF THE DRAWINGS

In order that the present invention can be fully understood it will now be described in more detail with reference to the accompanying drawings showing an example of the present invention in which.

DETAILED DESCRIPTION OF THE PREFERRED EMBODIMENT

Figure 1:
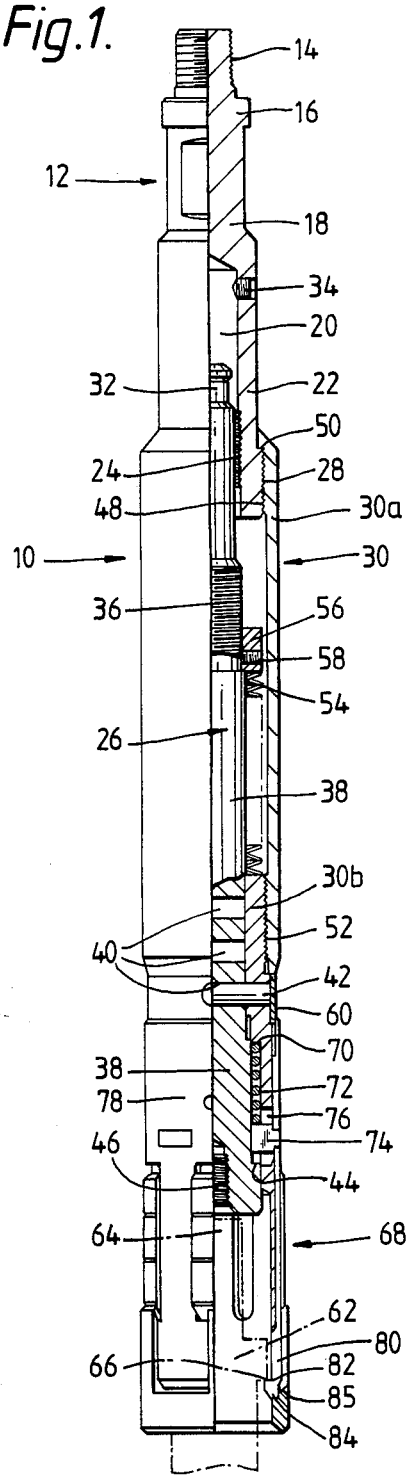
FIG. 1 shows the wireline tool, longitudinally half-sectioned, in its downward release mode with the core in its long reach position.

Referring initially to FIG. 1, a wireline running and pulling tool 10 in accordance with both aspects of the present invention is shown in isolation, that is to say before being attached to either a tool string at its top or a sub-surface tool at its bottom.

Figure 4:
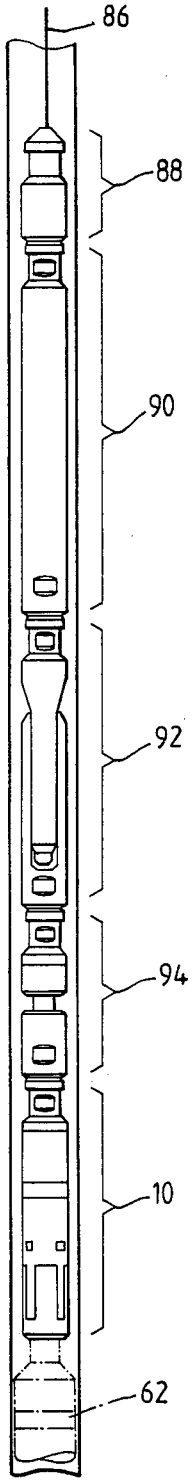
FIG. 4 shows the wireline tool of FIGS. 1 to 3 when forming part of an other wise conventional tool string.

The wireline tool 10 includes a top sub 12 including a thread 14 extending axially upwardly from a flange 16 which is of greater radial dimension than a solid stem 18 to permit attachment in a conventional manner to a tool string (see FIG. 4). Below the solid stem 18, the top sub 12 widens to present a hollow stem having a blind bore 20 surrounded by a sleeve 22. The sleeve 22 has an internal thread 24 for threaded connection to a core 26 and an external thread 28 for threaded connection to a housing 30.

The top sub 12 is connectible selectively to either the core 26 or the housing 30 and not to both simultaneously.

Figure 2:
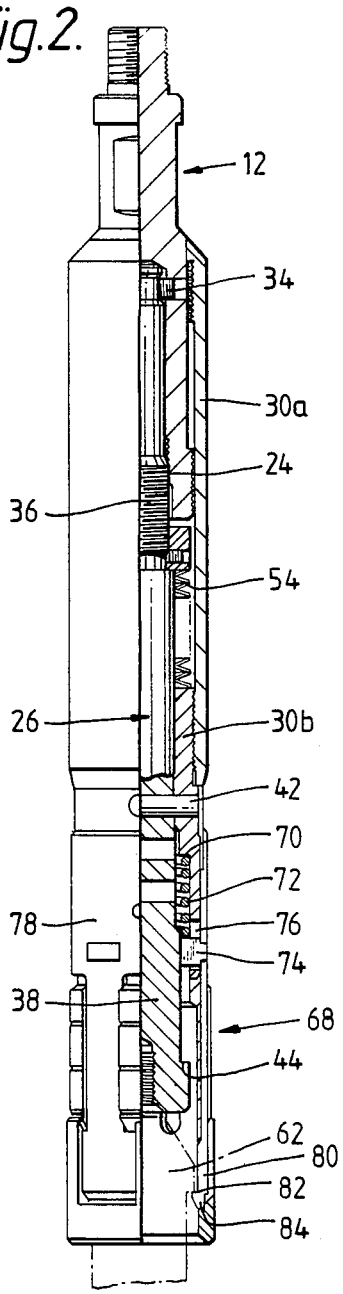
FIG. 2 shows the wireline tool, longitudinally half-sectioned, in its upward release mode with the core in its short reach position.
Figure 1:
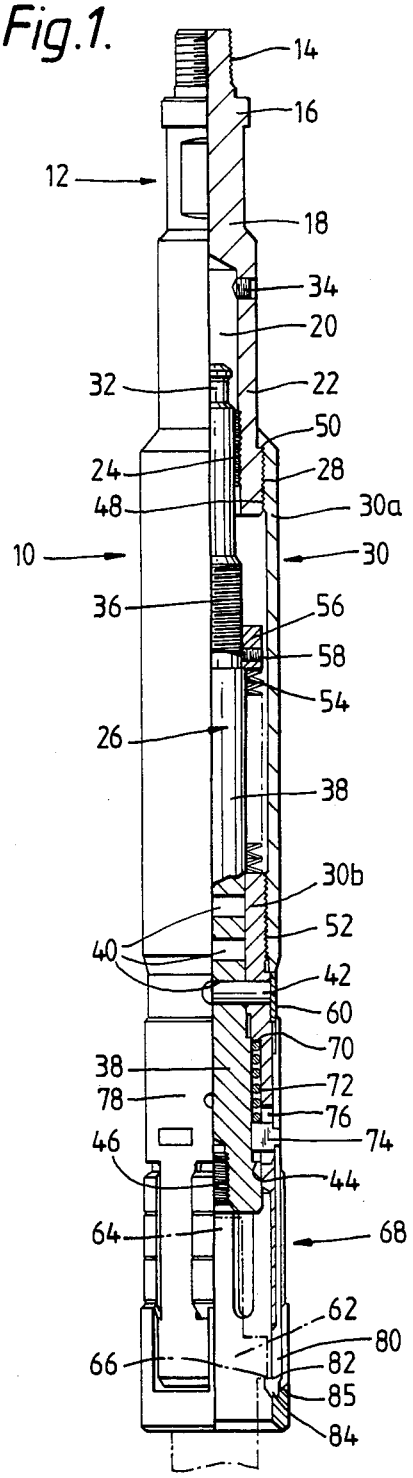
Figure 2:
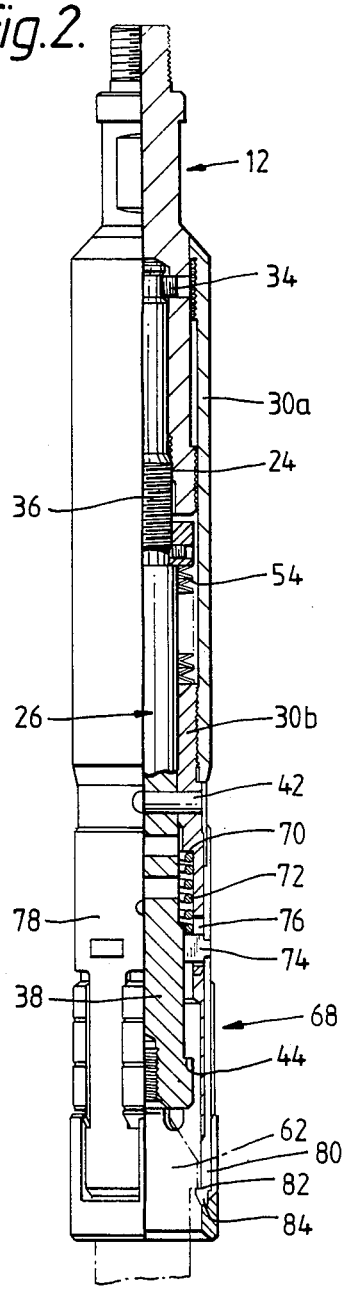

The core 26 includes, near its upper end, an annular groove 32 for receiving a locking screw 34 when a thread 36 on the core 26 is in threaded engagement with the internal thread 24 on the top sub 12 (see FIG. 2). Below the thread 36, the core 26 widens to form a body 38 through which a series of longitudinally spaced, transversely extending, apertures 40 have been provided. A total of three of the apertures 40 are illustrated, but there must be at least two and could be four or more. The purpose of the apertures 40 is to receive a shear pin 42 as will be discussed in more detail hereinafter. Near its lower end the core 26 again widens to present a step 44 and is internally machined to present a threaded blind bore 46.

The housing 30 includes both a top sleeve 30*a* and a pin support sleeve 30*b*.

The top sleeve 30*a* has an internal thread 48 near its upper end for threaded engagement with the external thread 28 on the top sub 12 (see FIG. 1). An inwardly facing shoulder 50 on the top sleeve 30*a* abuts a complementary shoulder on the top sub 12 when the top sleeve 30*a* is in full threaded engagement with the top sub 12 to assist in transmission of loads therethrough. The top sleeve 30*a* further includes an internal thread 52 near its lower end for threaded engagement with a complementary external thread near the upper end of the pin support sleeve 30*b*.

A main compression spring 54 is located around the body 38 of the core 26. The lower end of the spring 54 abuts the upper end of the pin support sleeve 30*b* and the upper end of the spring 54 abuts the lower end of an annular collar 56. The collar 56 is in threaded engagement with the thread 36 on the core 26 and is securable at a selected position along the thread 36 by a locking screw 58 to control the force exerted by the spring 54.

Figure 3:
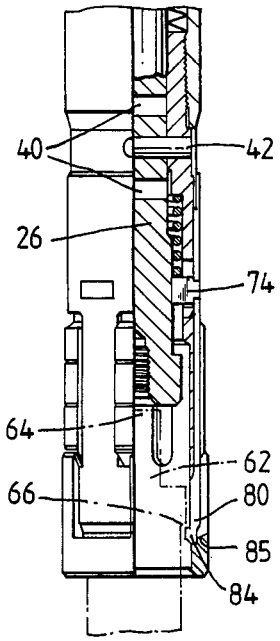
FIG. 3 shows a fragmentary part of the wireline tool, longitudinally half-sectioned, with the core in its mid reach position.

The shear pin 42 extends through an aperture provided therefor through the pin support sleeve 30*b* and into a selected one of the apertures 40 provided therefor in the body 38 of the core 26. The outer end of the pin 42 can be covered by a sleeve 60 in a conventional manner. The higher is the aperture 40 selected for receiving the pin 42, the lower is the longitudinal position of the core 26 relatively to the housing 30 and thus the shorter is the reach dimension of a sub-surface tool 62 with which the wireline tool 10 can be used. The reach dimension of each of the different sub-surface tools 62 shown in phantom (see FIGS. 1 to 3) is the distance between its upper end 64 and its latching surface 66.

The lower end of the pin support sleeve 30*b* carries latch means 68 for releasable engagement with the sub-surface tool 62. The precise construction of the latch means 68 is not relevant to the present invention in the sense that the present invention is equally applicable to different constructions for the latch means 68. However, the significant features of the illustrated construction of the latch means 68 will now be described.

The pin support sleeve 30*b* is formed with an internal shoulder 70 which locates the upper end of a helical spring 72, whose lower end abuts the inner parts of several pawls 74 which are longitudinally slidable in respective slots 76 formed in the pin support sleeve 30*b*. The spring 72 continuously urges the pawls 74 towards the lower ends of the slots 76. Outer parts of the pawls 74 are secured to a sleeve 78 whose lower end is split into several resiliently deflectable fingers 80. Each of the fingers 80 includes a shoulder 82 for location beneath the latching surface 66 of the sub-surface tool 62, and a free end 84 shaped for location within a complementary rebate formed at the inner end of a tapered surface 85 present by the pin support sleeve 30*b*. It will be appreciated that when the wireline tool 10 is being attached to the sub-surface tool 62, the tool 62 lifts the fingers 80 out of their rebates by compressing the spring 72. The fingers 80 are thus freed to flex resiliently outwards, until the upper end 64 of the tool 62 reaches the lower end of the core 26 by which time the latching surface 66 of the tool 62 has passed the tapered surface 85. The fingers 80 are then returned by the spring 72 to the initial positions within their rebates.

The wireline tool 10 is shown in FIG. 1 in its downwards hammer to release mode.

The top sub 12 is here connected to the housing 30 by the threads 28 and 48 so that a downwards hammer action is transmitted via the housing 30 to the shear pin 42. An equal and opposite reactive force is applied via the sub-surface tool 62 through the core 26 to the shear pin 42 and causes the pin 42 to shear. This releases the energy in the main spring 54 which drives the core 26 upwards relatively to the housing 30. As the core 26 slides upwards within the housing 30, the step 44 of the core 26 abuts the inner parts of the pawls 74 and lifts the pawls 74 which in turn lift the fingers 80 relatively to the housing 30. The free ends 84 of the fingers 80 are thus released from their rebates and the wireline tool 10 is released from the sub-surface tool 62.

The wireline tool 10 is shown in FIG. 2 in its upwards hammer to release mode.

The top sub 12 is here connected to the core 26 by the threads 24 and 36 so that an upwards hammer action is transmitted via the core 26 to the shear pin 42. An equal and opposite reactive force is applied via the sub-surface tool 62 through the fingers 80 and the housing 30 to the shear pin 42 and causes the pin 42 to shear. This releases the energy in the main spring 54 which drives the core 26 and the top sub 12 upwards relatively to the housing 30. The remainder of the releasing action is as already described.

As shown in FIG. 4, the wireline tool 10 is usually located at the lower end of a tool string including a wire 86, a wireline socket 88, a wireline stem 90, a wireline jar 92 and a wireline knuckle joint 94, all in a conventional manner.

I claim:

1. A wireline running and pulling tool (10), comprising: a top sub (12) for attachment to a tool string, a housing (30) carrying latch means (68) for releasable engagement with a sub-surface tool (62), and a shear pin (42) connecting the housing to a core (26) which is capable of sliding longitudinally relatively to the housing to release the latch means from the sub-surface tool after a hammer action transmitted through the tool string has broken the shear pin, the top sub having first connection means connectible to the housing and having second connection means connectible to the core, said first connection means being selected when transmission of a downwards hammer action for release is required and said second connection means being selected when transmission of an upwards hammer action for release is required.

2. A wireline running and pulling tool according to claim 1, in which the core is longitudinally adjustable relatively to the housing to accommodate sub-surface tools having different reach dimensions.

3. A wireline running and pulling tool according to claim 2, in which said adjustability is achieved by providing a series of longitudinally spaced apertures (40) in the core, with the shear pin being placed into a selected one of said longitudinally spaced apertures.

4. A wireline running and pulling tool according to claim 1, in which said first connection means is an external thread (28) for threaded connection to the housing, and said second connection means is an internal thread (24) for threaded connection to the core.

5. A wireline running and pulling tool according to claim 1, in which a compression spring (54) is located between the housing and an abutment (56) on the core, the abutment having an internal thread for threaded connection to the core.

6. A wireline running and pulling tool, comprising: a housing (30) carrying latch means (68) for releasable engagement with a sub-surface tool (62), and a shear pin (42) connecting the housing to a core (26) which is capable of sliding longitudinally relatively to the housing to release the latch means from the sub-surface tool after the shear pin has been broken, the core being longitudinally adjustable relatively to the housing to accommodate sub-surface tools having different reach dimensions, and said adjustability being achieved by providing a series of longitudinally spaced apertures (40) in the core, with the shear pin being placed into a selected one of said longitudinally spaced apertures.

7. A wireline running and pulling tool according to claim 6, in which a top sub (12) is provided for attachment to a tool string through which a hammer action is transmitted to break the shear pin.

8. A wireline running and pulling tool according to claim 6, in which a compression spring (54) is located between the housing and an abutment (56) on the core, the abutment having an internal thread for threaded connection to the core.

* * * * *